US010106310B2

(12) United States Patent
Bellinger et al.

(10) Patent No.: US 10,106,310 B2
(45) Date of Patent: Oct. 23, 2018

(54) AEROSOL DISPENSING APPARATUS

(71) Applicant: Smart Wave Technologies, Inc., Bethesda, MD (US)

(72) Inventors: Sean Bellinger, Kenosha, WI (US); Steve Slowik, Wheeling, IL (US); Michael Scola, Roselle, IL (US); Scott Arthur McMullen, Toronto (CA); Peter Zosimadis, Toronto (CA)

(73) Assignee: Smart Wave Technologies, Inc., Bethesda, MD (US)

( * ) Notice: Subject to any disclaimer, the term of this patent is extended or adjusted under 35 U.S.C. 154(b) by 0 days.

(21) Appl. No.: 15/344,056

(22) Filed: Nov. 4, 2016

(65) Prior Publication Data

US 2017/0073150 A1 Mar. 16, 2017

Related U.S. Application Data

(63) Continuation of application No. 14/435,886, filed as application No. PCT/CA2013/000883 on Oct. 15, 2013, now Pat. No. 9,522,775.

(60) Provisional application No. 61/714,081, filed on Oct. 15, 2012.

(51) Int. Cl.

| | |
|---|---|
| ***B67D 1/00*** | (2006.01) |
| ***B67D 7/14*** | (2010.01) |
| ***B65D 83/22*** | (2006.01) |
| ***B65D 83/26*** | (2006.01) |
| ***B65D 83/56*** | (2006.01) |
| ***B05B 12/08*** | (2006.01) |
| ***B65D 83/38*** | (2006.01) |

(52) U.S. Cl.
CPC ..... *B65D 83/22* (2013.01); *B05B 12/08* (2013.01); *B65D 83/26* (2013.01); *B65D 83/262* (2013.01); *B65D 83/38* (2013.01); *B65D 83/56* (2013.01)

(58) Field of Classification Search
CPC ..... B65D 83/22; B65D 83/26; B65D 83/262; B65D 83/56
USPC ..... 222/61
See application file for complete search history.

(56) References Cited

U.S. PATENT DOCUMENTS

| | | | |
|---|---|---|---|
| 3,214,062 | A | 10/1965 | Mahon |
| 3,589,563 | A | 6/1971 | Carragan et al. |
| 3,700,200 | A | 10/1972 | Batchelor et al. |
| 3,726,437 | A | 4/1973 | Siegel |
| 3,779,425 | A | 12/1973 | Werner |

(Continued)

FOREIGN PATENT DOCUMENTS

| | | | |
|---|---|---|---|
| CA | 2583628 | A1 | 4/2006 |
| GB | 2443729 | A | 5/2008 |

(Continued)

OTHER PUBLICATIONS

Extended European Search Report Application No. 13846707.1 Completed: Jun. 14, 2016; dated Jul. 25, 2016 5 pages.

(Continued)

*Primary Examiner* — Jeremy W Carroll
(74) *Attorney, Agent, or Firm* — Whitmyer IP Group LLC

(57) ABSTRACT

A dispensing system adapted for repeated activation of an aerosol can is described. The dispensing system includes components that improve the ability to receive and secure aerosol cans of different sizes within the dispensing system as well as improving the reliability and energy efficiency of the system.

14 Claims, 12 Drawing Sheets

(56) References Cited

U.S. PATENT DOCUMENTS

| | | | | |
|---|---|---|---|---|
| 3,952,916 | A | 4/1976 | Phillips | |
| 4,006,844 | A | 2/1977 | Cords | |
| 4,063,664 | A | 12/1977 | Meetze, Jr. | |
| 4,238,055 | A | 12/1980 | Staar | |
| 4,272,996 | A | 6/1981 | Sauerwein | |
| 4,428,512 | A | 1/1984 | Nosek | |
| 4,563,156 | A | 1/1986 | Bissig | |
| 5,038,972 | A | 8/1991 | Muderlak et al. | |
| 5,630,530 | A | 5/1997 | Geier et al. | |
| 5,884,808 | A | 3/1999 | Muderlak et al. | |
| 5,938,076 | A | 8/1999 | Ganzeboom | |
| 6,039,212 | A | 3/2000 | Singh | |
| 6,216,925 | B1 | 4/2001 | Garon | |
| 6,293,442 | B1 | 9/2001 | Mollayan | |
| 6,419,122 | B1 | 7/2002 | Chown | |
| 6,581,804 | B1 | 6/2003 | Ciavarella et al. | |
| 7,377,493 | B2 | 5/2008 | Thomas | |
| 7,614,526 | B2 | 11/2009 | Gaillen | |
| 7,893,829 | B2 | 2/2011 | Sipinski et al. | |
| 9,642,501 | B2 * | 5/2017 | Atkins | A47K 5/1217 |
| 2006/0076366 | A1 | 4/2006 | Furner et al. | |
| 2007/0199952 | A1 | 8/2007 | Carpenter et al. | |
| 2008/0245299 | A1 | 10/2008 | Nielsen et al. | |
| 2009/0000023 | A1 * | 1/2009 | Wegelin | A47K 5/1217 4/623 |
| 2010/0149232 | A1 * | 6/2010 | Cai | B41J 2/175 347/7 |
| 2011/0095044 | A1 | 4/2011 | Sipinski | |
| 2013/0020351 | A1 | 1/2013 | Pelfrey | |
| 2013/0068783 | A1 | 3/2013 | Gasper et al. | |
| 2014/0231448 | A1 * | 8/2014 | Wegelin | B05B 1/00 222/23 |
| 2014/0231449 | A1 * | 8/2014 | Wegelin | B67D 7/346 222/23 |
| 2016/0184851 | A1 * | 6/2016 | McNulty | B05B 12/08 222/1 |

FOREIGN PATENT DOCUMENTS

| | | | |
|---|---|---|---|
| GB | 2469056 | A | 10/2010 |
| NL | 7010940 | A | 2/1971 |

OTHER PUBLICATIONS

International Search Report and Written Opinion of the International Searching Authority Application No. PCT/CA2013/000883 Completed: Jan. 13, 2014; dated Jan. 21, 2014 11 pages.

European Office Action Application No. 13846707.1 dated Nov. 7, 2017 3 Pages.

* cited by examiner

AEROSOL DISPENSING APPARATUS

FIELD OF THE INVENTION

A dispensing system adapted for repeated activation of an aerosol can is described. The dispensing system includes components that improve the ability to receive and secure aerosol cans of different sizes within the dispensing system as well as improving the reliability and energy efficiency of the dispensing system.

BACKGROUND OF THE INVENTION

Numerous products exist to provide the basic function of automatically activating an aerosol can. One such type of product is an air freshener that automatically dispenses or can be programmed to periodically dispense a small quantity of the contents of the aerosol can into a room.

The majority of aerosol dispensing products or dispensing systems allow an aerosol can to be secured within the dispensing system and thereafter automatically activate the aerosol can such that a specific and small quantity of product can be dispensed per activation. In a typical air freshener type system, the dispenser system is usually designed as a cabinet to be mounted on a wall in which the aerosol can is hidden from view behind an opening door that can be opened to replace an aerosol can. The dispensing system will typically include a power source and controller that activates an electromechanical gear and hammer assembly that presses down on the nozzle of the aerosol can in order to periodically release the aerosol can contents. The controller may allow a user to program the dispensing frequency and volume. The devices are typically battery powered and use timers to turn the activation systems on and off.

A significant problem with past designs of dispensing systems is that the aerosol refill cans used in these dispenser systems have different sizes which leads to a number of operational problems that are discussed below.

For example, while most aerosol cans are manufactured from standard tinplate steel or aluminum, the large number of different manufactures, products being dispensed and sheer volume of aerosol cans being manufactured results in a wide range of sizes of aerosol cans. That is, while aerosol cans are mass produced in "industry standard" sizes, the lack of criticality in maintaining defined tolerances in the size of the cans results in industry standard sized cans varying significantly from manufacturer to manufacturer. This is particularly true with aluminum cans where the heights of a "standard" can in fact vary significantly. These differences can often be as much as several millimeters which, depending on the final use/operation of the can, may be of no importance or lead to various problems as described herein.

In particular, if an aerosol can is simply hand-held, differences in sizes between aerosol cans is of no importance. As such, as many aerosol can products are designed for hand-held use, minor variances in height are generally not important to the majority of product applications and, as such, the manufactured sizes do not need to be tightly controlled. As most aerosol cans are still used in this manner, there has been not been a need for manufacturers to shift their manufacturing practices. However, fitting different sizes of aerosol cans into a standard size dispensing system can be problematic.

Aerosol Can Valve Mechanisms

As is also known, aerosol cans have valve and nozzle mechanisms that are used to physically dispense product from the aerosol can. In a typical design, a cylindrical tube having a bottom is fitted with a domed cap containing a valve apparatus. As shown in FIG. 1, (A) showing a valve closed and (B) showing a valve open, the valve apparatus typically includes a valve mounting cup 1 that is sealed to or forms part of the domed cap. The valve mounting cup retains a valve housing 1*a* and a gasket 2 through which a valve stem 3 protrudes, the valve stem having an exterior side and an interior side. The exterior side is substantively a hollow tube to which an actuator 4 is attached. The actuator will normally be press fit over the valve stem and provides a 90° re-direction of can contents passing through the valve stem and an orifice insert 5. The exterior side of the valve stem contains a perpendicular orifice located at or above the sealing gasket. The interior side of the valve stem is fitted with a spring cup 6 that is normally biased against the gasket by a spring 7 such that the spring cup is sealed against the gasket and prevents the release of can contents. The base of the interior side will serve as a plug. The valve housing 1*a* contains an interior chamber that is normally open to the pressurized contents of the can through a dip tube 8 that carries the aerosol can contents from the bottom of the can to the valve mechanism. When the actuator and valve stem are depressed against the spring (B), the orifice in the stem descends below the gasket such that the can contents in the reservoir can flow through the orifice insert and out of the can. Simultaneously, the base of the stem may seat in the bottom of the reservoir, stopping the flow of can contents through the dip tube. Thus, in this case, only the can contents that were resident in the reservoir are allowed to escape through the orifice in the valve stem. When pressure on the actuator and valve stem is released, the spring will cause the spring cup to move against the gasket in order to reseal the valve cup and gasket and prevent the flow of can contents while the base of the stem is lifted to allow the contents of the can to recharge the reservoir in the valve (if present). The spring is contained within a valve housing that is supported by the valve cup. Aerosol cans may also be fitted with metered valves with dosing cups to provide fixed volume dosing of product.

As an aerosol can is generally a disposable product, the life of the valve mechanism is designed to last for an estimated number of actuations when operated within typical operating parameters. As a result, valve mechanisms may be subject to failure beyond a certain number of actuations and/or abnormal operation of the valve mechanism. In particular, one specific problem for aerosol cans that are mounted within dispensing systems, is that repeated actuation of the valve in an off-axis direction may lead to premature failure of the valve should the gasket, valve stem or spring cup fail.

In a metered installation, a metered valve will be used to allow a typical aerosol to deliver between 3000 and 9000 activations. With an automatic dispenser, as the can does not move between actuations, off-centered or nonlinear activation that is repeated over and over again results in a lateral force being applied to the same point of valve stem and seal of the valve. This repeated stress will often cause the valve stem seal to fail and leak at some point prior to the can being depleted of its contents allowing the gas and can contents to escape around the stem. Within the industry, this is called bypass.

At the very least, the failure of a seal resulting in leakage of can contents can be messy and time-consuming to clean up. Leakage may also cause the system to not operate properly as a result of residues building up around the valve stem. More importantly, seal failure will often result in damage to the dispensing apparatus from the solvents within the aerosol cans. As the dispensing apparatus is the more expensive component, it is obviously desirable to prevent damage to this type of equipment.

A related problem occurs when the valve is not properly activated and the spray is not fully atomized. Since the dispenser is mounted in a fixed position any dripping or sputtering of the spray can result in accumulation of the fragrance formula on the dispenser cover or the floor directly in front of the dispenser. Since aggressive solvents are used in fragrance formulations, this accumulation of material can also damage the surface of the cover or floor.

Size and Configuration Problems and Past Solutions

Supply Chain Problems

Furthermore, the dispensing systems used with aerosol cans are usually proprietary designs unique to each manufacturer. As a result of differences in aerosol can sizes as discussed above, these size differences often require that the manufacturer of the dispenser and aerosol refill system (eg. an air freshener system) to standardize with a specific can and valve supplier in order to ensure that the can will fit and operate properly in a particular manufacturer's dispenser(s).

Since refill components are costly and space consuming, it is often difficult to maintain sufficient inventory reserves to ensure against interruption of supply particularly with tinplate which is a commodity that can be in limited supply. As a result, interruptions of supply to the market are frequent which often results in a loss of immediate and future business.

As a result, this often makes it difficult for the manufacturer to switch aerosol can suppliers when the supply of a particular aerosol can is in short supply or no longer economical. Moreover, as is known, once customers have switched suppliers it is often difficult to regain their business.

Shelves and Yokes

In some systems, manufacturers have addressed the can height issue by providing a shelf that can be removed to accommodate a larger can. Other manufacturers attempt to secure the can in the dispenser with a yoke device that supports the can at the neck.

The use of shelves in dispensers also has a poor compliance rate. Customers generally require foolproof systems that can be serviced and maintained with a minimum of complexity. Untrained service personnel generally do not have the inclination and/or patience to fiddle with dispensers or refills to make them work.

Furthermore, the use of a neck ring or yoke requires close monitoring in the manufacturing process to ensure that the can will slide into the dispenser easily. Importantly, there is often a tolerance stack up problem with the valve, can and crimping process that can significantly reduce the gap between the valve and the can that fits onto the yoke in the dispenser. This constriction of the gap results in cans that are difficult to install and/or difficult to remove. Further still, as these dispensers are typically installed at a height of around seven feet from the floor, service personal are often unable to remove the can without mounting a ladder and may even pull the dispenser off the wall in their attempts to remove the can. As such, there has been a need for systems where access to batteries is provided at a lower height so as to minimize the complexity and time required to replace batteries.

Keying Between Can and Dispenser

Another significant concern of dispenser manufacturers is the use of unauthorized refills within one manufacturer's dispenser. That is, as it is more expensive to design and build a dispenser, a manufacturer will generally want to ensure that authorized aerosol cans are used within a specific dispenser. However, as the aerosol refills are manufactured with standard components it becomes relatively easy for competitors to produce refills that will operate in another's dispenser. This practice results in the loss of annuity income from refill sales along with potential performance problems and damage to the dispenser associated with the use of unauthorized refills. Thus, there has been a need for a system that prevents the use of unauthorized refills.

Past attempts to prevent the use of unauthorized cans have been the use of specific mechanical designs of nozzles and/or mechanical keys that obstruct or prevent "regular" can designs to be mounted within a dispenser. However, many of these systems can be overcome by physically modifying the "regular" can to fit a dispenser with a key system.

Employing mechanical keys to eliminate the use of unauthorized refills has only marginal success. These keys tend to annoy customers, interfere with the activation of the can and can often be easily overcome with a few strokes of a utility knife.

Power Consumption

Another type of problem with automatic dispensers is power consumption. As the majority of automatic dispensers are battery operated, in the commercial and industrial markets, service costs are an important factor in choosing an automatic dispensing system such as an air care system. For example, in the case of automatic air fresheners and as noted above, a dispenser is usually located high on a wall in order to avoid tampering by the public. As a result, if access is difficult, changing batteries can be difficult and time consuming. In most cases, a minimum of one year battery life is expected by most customers and many existing dispensers fail to meet this requirement.

The majority of dispensers in the market use similar activation mechanisms. These mechanisms consist of a small DC motor mounted to a motor mount plate with a series of plastic gears. The final gear is a hammer gear that actuates the valve by pressing on the nozzle or actuator of the aerosol can. The hammer gear forces the valve open and continues to pressure that valve until the motor stalls and/or a predetermined interval is reached and the mechanism stops. These mechanisms usually rely on the valve spring to reset the gear to their initial state.

While such mechanisms are effective, they are also inefficient with respect to power consumption. Moreover, such systems may also apply substantially off-center forces on the valve stem.

The hammer mechanism previously described is not particularly efficient as it requires additional stroke length to compensate for the differences in height of the can and to ensure a complete actuation. This often creates a condition where the motor is stalled. This condition can create a tenfold increase current consumption and exert uneven and excessive force on the valve stem. In these systems, the power consumption is particularly inefficient when the batteries are fresh and the voltage is higher as such systems do not monitor battery voltage and only use a fixed time interval to turn a motor on and off.

Programming

Further still, dispensing apparatus have controllers that are programmed to dispense product at various intervals. The controllers may include various sensors and/or modes of operation that provide various functionalities to the dispenser. For example, dispensers may be programmed to dispense at regular intervals based on an internal clock that is programmed by the user. In this case, a user at the time of installation would program the time into the controller and then typically select a specific time interval for dispensing depending on the anticipated need. Such intervals may be presented as 10, 20, 30 minute time intervals for example. In order to overcome the problem of dispensing when people are not around, past systems have included light or motion sensors into the dispensing apparatus such that dispensing will only occur if the lights in the room are on or movement is detected. However, as is well known, in many installations, lights may be left on 24 hours a day that may result in over-dispensing and/or motion sensing that may result in dispensing that is under-correlated to actual person volumes.

Similarly, such systems may include programs that signal that service may be required based on a pre-set time interval.

While some systems may be programmed by the user to establish a time reference for determining a dispensing frequency, research has indicated that the relatively simple steps of programming a time into a unit is very often not undertaken thus preventing any resident dispensing programs from being logically referenced to a desired dispensing frequency by the controller. For example, if a program changes dispensing frequency from daytime to nighttime, an improperly referenced time will render changes in frequency irrelevant.

Furthermore, any more complicated programming steps are unlikely to be completed during installation or at other times.

Accordingly, there has been a need for systems that overcome the above problems.

PRIOR ART

A review of the prior art has revealed that past systems have been designed that automatically dispense aerosol products. However, the prior art does not overcome the technical problems as recognized and solved by the Applicant.

For example, U.S. Pat. No. 3,952,916 discloses an automatic dispenser for periodically actuating an aerosol container. The discharge outlet of the aerosol container is maintained in fixed alignment with the housing of the dispenser, while the aerosol container is periodically moved up and down with respect to the container valve via a lever in contact with the bottom of the container in order to discharge a quantity of the contents in the aerosol container. The lever is automatically driven by an actuation mechanism including a DC motor, a reduction gear train and an electric timing circuit driven by a pair of batteries. Importantly, the '916 patent does not disclose a dispenser that can accommodate a variety of can sizes, nor does it disclose an actuation mechanism that activates the valve with a linear stroke in the center of the valve.

U.S. Pat. No. 3,589,563 discloses a high efficiency automatic aerosol dispenser for producing periodic discharge from an aerosol container. The actuation mechanism includes a motor, a drive train, a cycling member and a pivotable actuating arm having a finger for engagement with the cap of the aerosol container. The actuation arm is biased against a cammed surface that determines the on and off sequences. In order to be highly efficient, the actuation cycle of the '563 patent includes a standby portion in the order of 15 minutes or more wherein a timing circuit and a switch causes the motor of the actuation mechanism to be turned off, thereby using negligible current from a battery during the standby period. Due to the storage of energy in the biasing spring attached to the actuating arm during the actuation period, an extremely low-peak load is required, allowing the dispenser to operate unattended by battery for weeks or months at a time. Importantly, the actuation mechanism of the '563 patent works against a spring during operation.

U.S. Pat. No. 6,293,442 discloses a timed spray dispenser for distributing a liquid deodorizer from an aerosol spray can that can be adjusted to accommodate a variety of can heights. In one embodiment, the housing of the dispenser includes an adjustable-height base attached to the housing by slideable posts, wherein the posts are secured at the correct height using thumb screws. Another embodiment includes a fixed height housing and a sliding shelf. Importantly, the height adjustment system needs to be manually adjusted and secured by an operator. Furthermore, the actuation mechanism of the '442 patent dispenser utilizes a lever arm to periodically dispense the contents of the spray can. In this system, a complex drive system using belts is provided.

U.S. Pat. No. 3,214,062 teaches an actuation device for automatically and periodically activating an aerosol dispenser can. The actuation device comprises a motor, a cam means, and a pair of levers that smoothly and rapidly depress the can valve. Importantly, the levers are actuated against a spring. Furthermore, this patent does not teach a device that can accommodate a variety of can heights.

SUMMARY OF THE INVENTION

In accordance with the invention, there is provided an aerosol can dispensing system for repeated dispensing of the contents of an aerosol can, the aerosol can having a body and an upper end operatively supporting an aerosol can valve mechanism, the aerosol can dispensing system comprising: an aerosol can adapter having an aerosol can retaining surface for retaining the upper end of the aerosol can; a scotch yoke drive mechanism operatively connected to the aerosol can adapter, the scotch yoke drive mechanism having: an electric motor and power system providing rotary power; a torque arm operatively connected to the electric motor, the torque arm supporting a spindle offset with respect to a rotation axis of the electric motor; a lever arm having a first end having a slot engaged with the spindle and a second end engageable with the aerosol can valve mechanism, the first and second ends pivotable about a pivot point; wherein rotation of the torque arm about the rotation axis causes reciprocating near linear movement of the spindle within the slot and movement of the second end relative to the aerosol can valve mechanism to effect opening and closing of the aerosol can valve mechanism.

In a further embodiment, the lever arm has dimensions such that the second end provides a substantially linear force to the aerosol can valve mechanism that is substantially parallel to a longitudinal axis of the aerosol can to effect opening of the aerosol can valve mechanism.

In another embodiment, the spindle is operatively positioned with respect to the torque arm to effect maximum torque to the lever arm at a position to initiate opening of aerosol can valve mechanism.

In another embodiment, the system includes a gear train operatively connected to the electric motor and torque arm.

In yet another embodiment, the system includes a position switch operatively connected to the torque arm to turn off the power system when the lever arm is fully disengaged from the aerosol can valve mechanism.

In a still further embodiment, the system includes a base operatively connected to the aerosol can adaptor, the base having a base surface engageable with the aerosol can body for securing the aerosol can within the aerosol can adaptor. The base may include a spring biasing the base surface towards the aerosol can adapter and a lock selectively engageable with the base surface for fixing the base surface at a specific position with respect to the aerosol can adaptor.

In one embodiment, the lever arm has a flexibility sufficient to compensate for an over-height aerosol can valve mechanism seated within the aerosol can adaptor, and wherein the lever arm can flex to reduce the force being applied to an over-height aerosol can valve mechanism at a position of maximum aerosol can valve mechanism opening.

In another embodiment, the system includes at least one LED emitter/receiver pair operatively connected to a controller, the at least one LED emitter/receiver pair and controller having means for detecting if an aerosol can mounted within the system is an authorized aerosol can and wherein the controller prevents actuation of the aerosol can if an unauthorized aerosol can is present and enables actuation if an authorized aerosol can is present.

In one embodiment, the system includes an aerosol can having at least one photoreflective surface for interfacing with the at least one LED emitter/receiver pair.

In another embodiment, the system includes a battery drawer within the base.

In yet another embodiment, the system includes a controller operatively connected to the electric motor wherein the controller turns on the electric motor to initiate a dispense cycle based on a time signal and the electric motor is turned off based on a pre-determined position of the torque arm.

In another aspect, the invention provides a method for determining if an aerosol can is authorized for use within an aerosol can dispenser where the aerosol can dispenser has an aerosol can dispensing system for repeated mechanical contact with a nozzle of an aerosol can operatively connected to the aerosol can dispenser and where the aerosol can dispensing system has a controller having means for activation of the aerosol can dispensing system for repeated activation of the aerosol can nozzle, the method including the steps of: (a) mounting an aerosol can within the aerosol can dispenser to engage the aerosol can nozzle with the aerosol can dispensing mechanism; (b) activating at least one LED emitter/receiver pair operatively connected to the controller, the LED emitter/receiver pair for emitting LED light against an outer surface of an aerosol can and receiving reflected light from the outer surface of the aerosol can; (c) detecting if the reflected light corresponds to an authorized reflected light signal pattern; wherein if the reflected light signal pattern is authorized, enabling the aerosol can dispensing mechanism to dispense a quantity of aerosol can contents and wherein if the reflected light signal pattern is not authorized, preventing activation of the aerosol can dispensing mechanism.

In another aspect, the invention provides an aerosol can having at least one photoreflective surface for interfacing with the at least one LED emitter/receiver pair and/or the photoreflective surface has reflective properties for operatively interacting with at least one LED emitter/receiver pair operatively connected to the dispensing apparatus for authorizing use of the aerosol can within the dispensing apparatus. The photoreflective surface may be a band around the circumference of the aerosol can.

BRIEF DESCRIPTION OF THE DRAWINGS

The invention is described with reference to the accompanying figures in which.

DETAILED DESCRIPTION OF THE INVENTION

Figure 1:
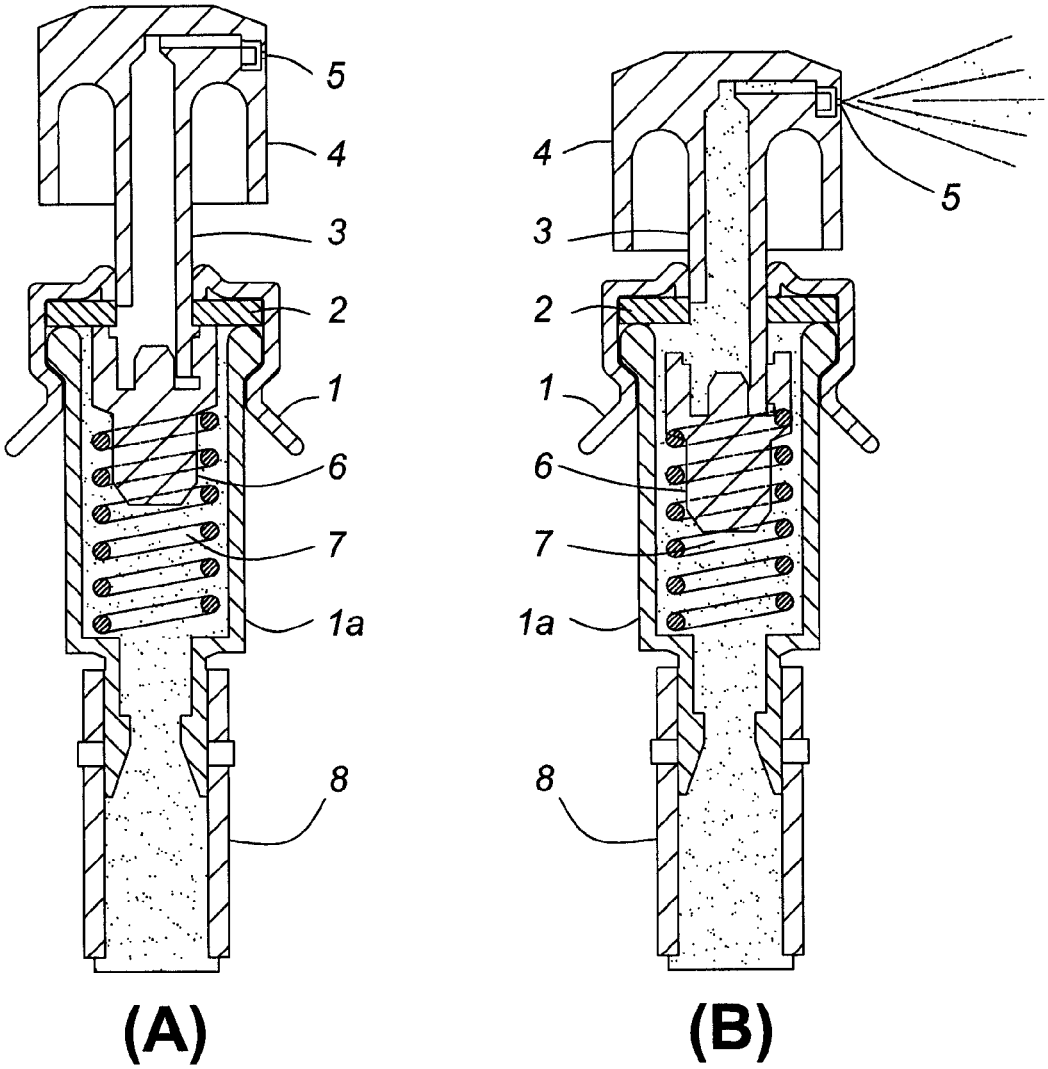
PRIOR ART FIG. 1
FIG. 1 is a schematic diagram showing a typical aerosol can valve mechanism in accordance with the prior art in a sealed (A) and dispensing (B) position.
Figure 2:
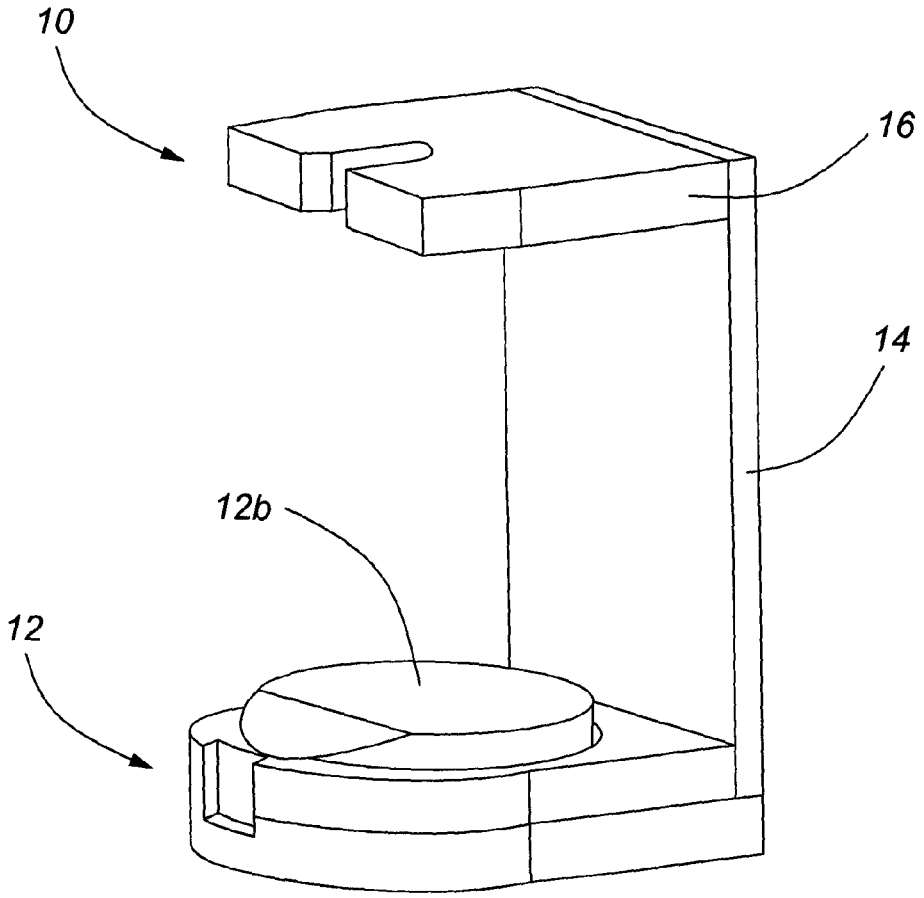
FIG. 2 is a schematic view of a dispenser showing an aerosol can support in accordance with one embodiment of the invention.
Figure 3:
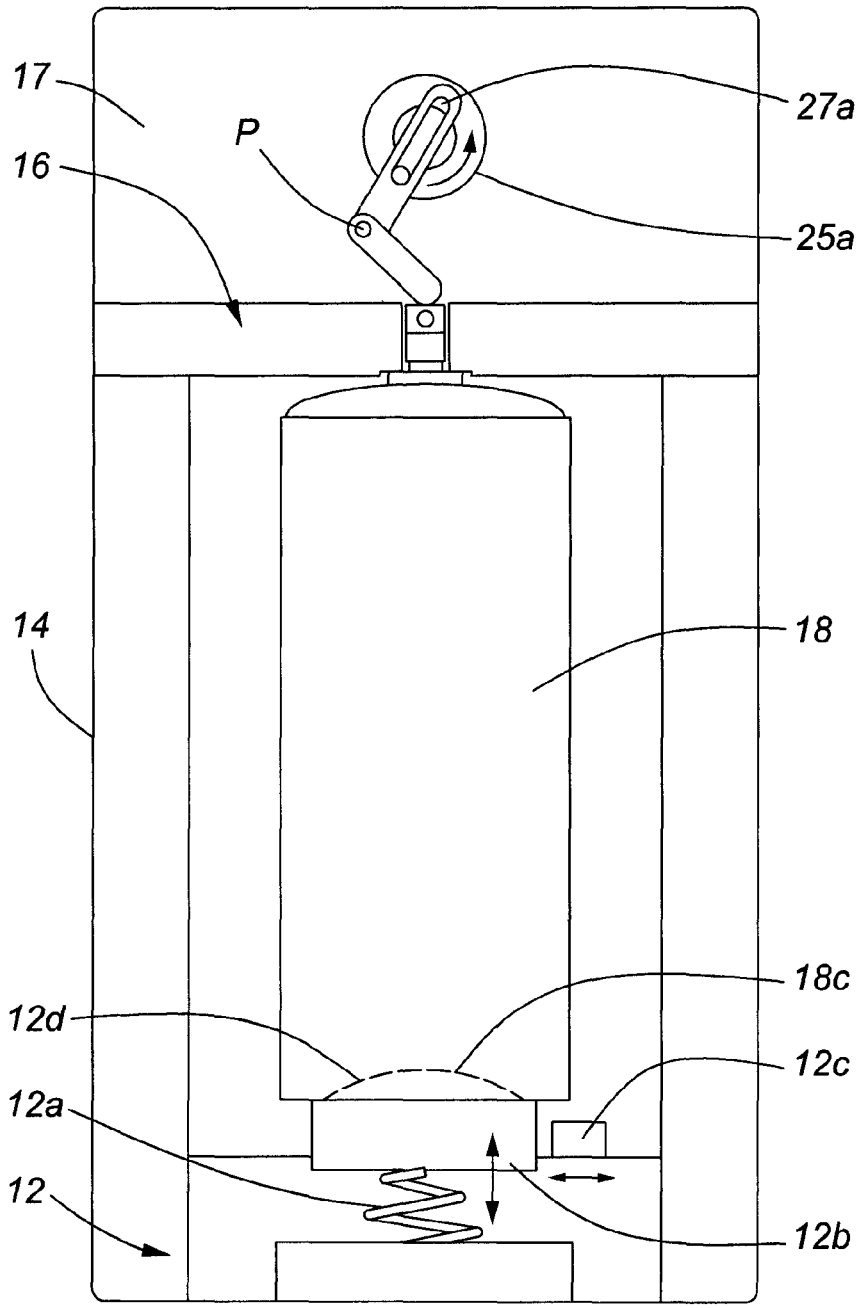
FIG. 3 is a sketch of an actuator mechanism and support system in accordance with one embodiment of the invention.
Figure 4:
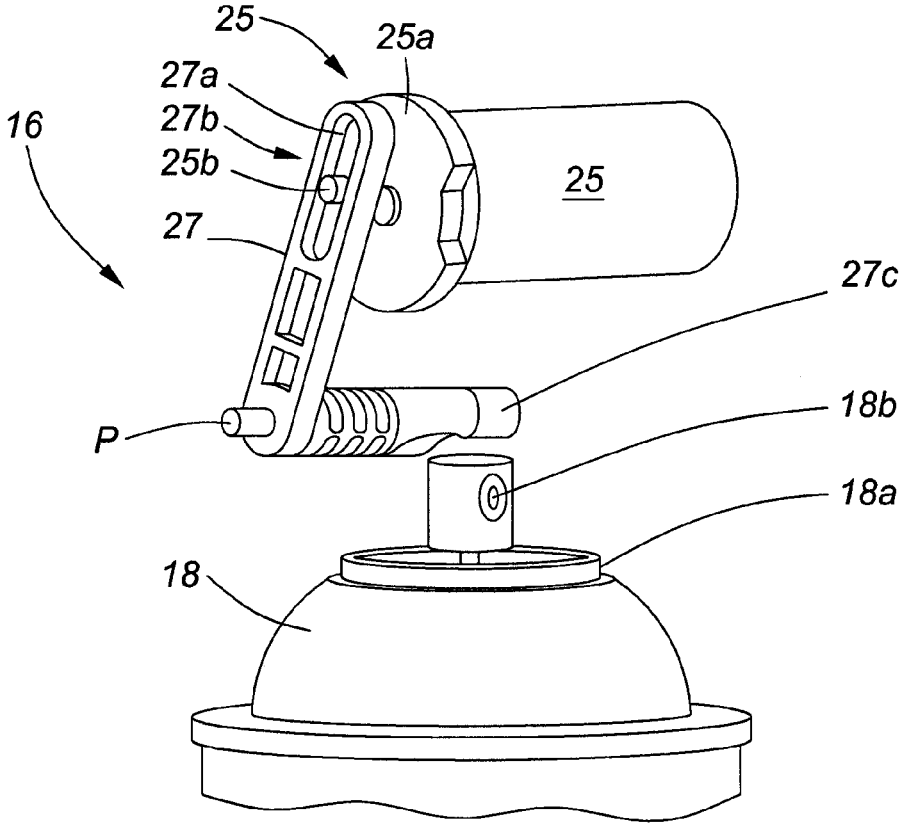
FIG. 4 is a perspective view of an actuator mechanism in accordance with one embodiment of the invention.
Figure 5:
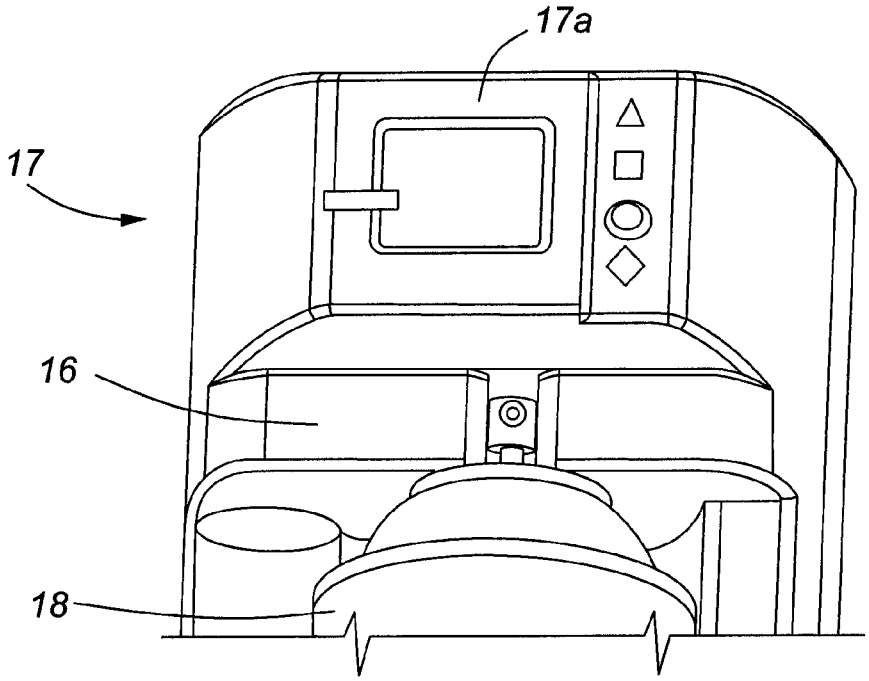
FIG. 5 is a perspective view of an aerosol can adaptor in accordance with one embodiment of the invention.
Figure 5A:
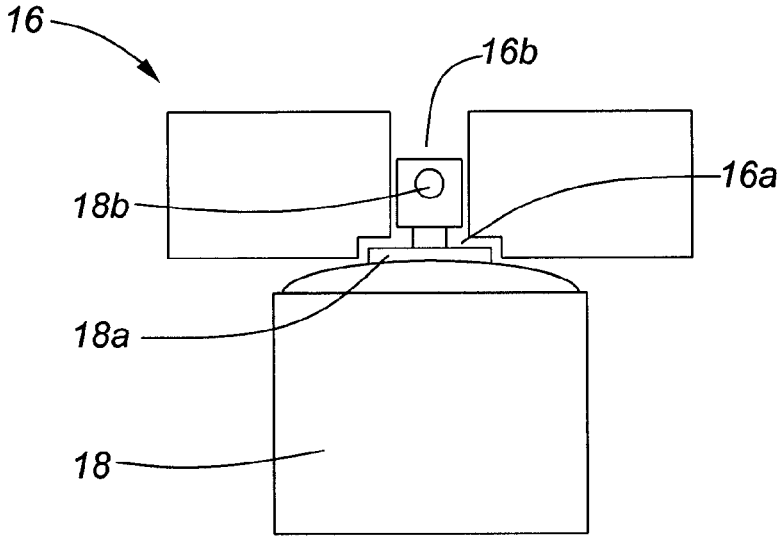
FIG. 5A is a sketch of an aerosol can adaptor in accordance with one embodiment of the invention.
Figure 6:
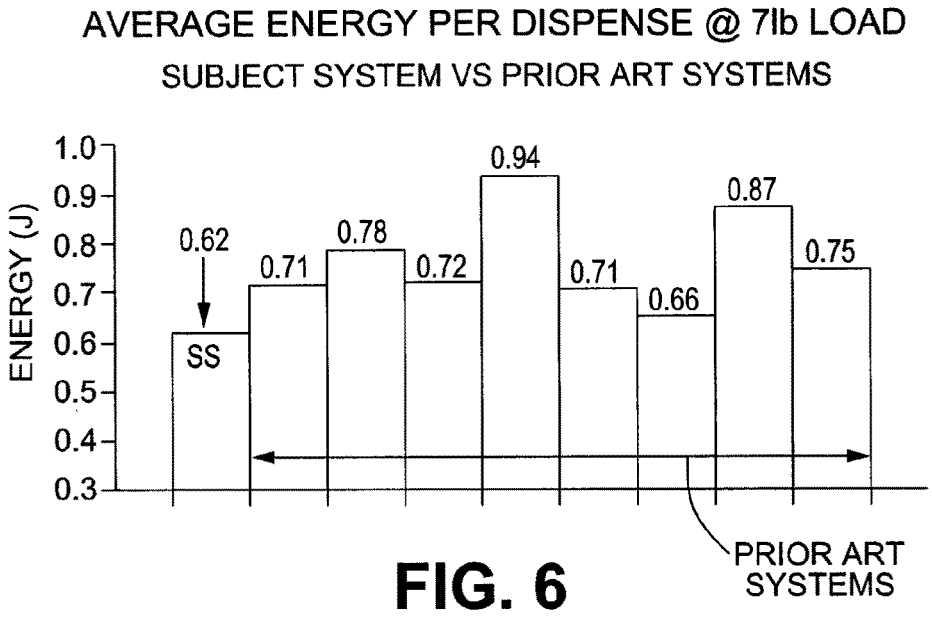
FIG. 6 is a graph comparing average energy per dispense for an actuation system in accordance with the invention (SS) and prior art systems at a 7 pound load.
Figure 6A:
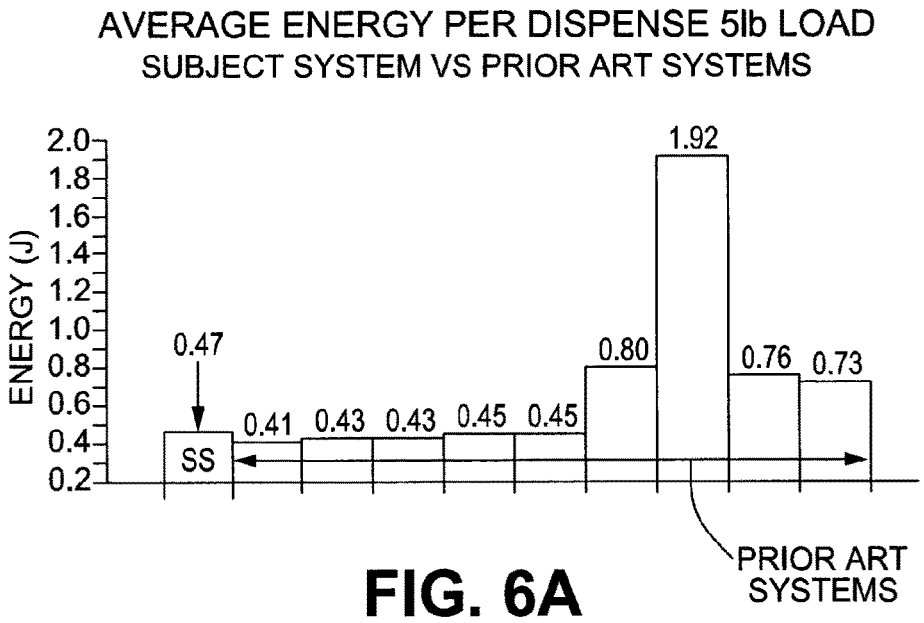
FIG. 6A is a graph comparing average energy per dispense for an actuation system in accordance with the invention (SS) and prior art systems at a 5 pound load.

With reference to the Figures, an improved dispensing apparatus for holding and securing an aerosol can or the like and automatically activating the aerosol can to dispense a volume of the aerosol can contents is described. As shown in the FIGS. 2-5, the apparatus generally includes a can support and securing system 10 as shown in FIGS. 2, 3 and 5 and a drive mechanism as shown in FIGS. 3 and 4. Collectively, the apparatus enables aerosol cans having different sizes to be effectively secured to a dispensing apparatus and thereafter allow the dispensing of the contents of the aerosol can with improved reliability and power consumption in comparison to past systems.

Can Support and Securing System

As shown in FIGS. 2, 3, 5 and 5A, a can support and securing system 10 (CSSS) is described. The CSSS includes a base 12, frame 14 and can top adaptor 16. As shown schematically in FIG. 3, the base 12 operatively supports a spring 12*a* and a can support 12*b* telescopically received in the base. The can support 12*b* will preferably include a convex surface 12*d* for engagement with the underside of an aerosol can 18 as shown in FIG. 3.

The frame 14 connects the base to the can top adaptor 16 as shown in FIG. 2. As shown schematically in FIG. 5A, the can top adaptor includes a recess 16*a* and slot 16*b* adapted for receiving the upper surfaces of an aerosol can 18. The recess 16*a* is generally a cylindrical recess for receiving the upper lip 18*a* of an aerosol can. The recess 16*a* is generally dimensioned to have a diameter greater than the normal range in sizes from different manufacturers of aerosol cans. The slot 16*b* receives the nozzle 18*b* of the aerosol can as also shown in FIG. 5. Above the can top adaptor is compartment 17 that supports a motor assembly and system electronics as described below and includes a cover 17*a* for covering the motor assembly and electronics.

In operation, an aerosol can 18 is positioned within the frame 14 such than the lower concave surface 18*c* of the aerosol can is over the convex surface 18*c* of the base 12. In installing the AC, the user pushes down gently against the can support 12*b* such that the spring is depressed thereby allowing the upper end of the AC to move with respect to the can top adaptor 16 and allow the upper lip 18*a* and nozzle 18*b* to be inserted into the recess 16*a* and slot 16*b*. As the upper lip and nozzle are seated, the upward pressure of the spring 12*a* biases the AC upwardly within the can top adaptor 16.

Thereafter, a dispenser cover (not shown) is closed such that the aerosol can is covered and locked to prevent unauthorized removal of the aerosol can. In addition, prior to closing the dispenser cover, the support lock 12*c* is activated if present. As a result, the AC is centered and locked in the ideal position for actuation. In one embodiment, the lock support 12*c* is a sliding member that is secured to the base 12 that can engage with the can support 12*b* so as to secure the can support at a specific level with respect to the base.

In order to remove an AC when the refill is empty, the service person opens the dispenser cover and unlocks the support lock (if present) to release the can support allowing the empty can to be depressed downwardly and allowing the empty to be pulled out of the dispenser. The components of the mechanism are generally configured such that a refill can only be inserted in the correct configuration for operation.

Actuation Mechanism

As discussed above, the importance of a linear actuator that is well centered on the valve stem was not widely recognized in previous designs. That is, the failures discussed above do not occur immediately after installation and are otherwise relatively infrequent. Thus, periodic problems with the aerosol can have often been blamed on random valve component failure as opposed to a fundamental problem with the way the aerosol can is operated within the dispenser.

Figure 4A:
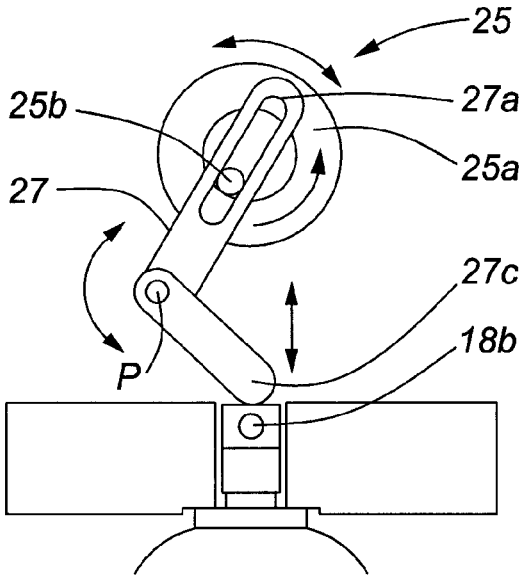
FIG. 4A is a sketch of an actuator mechanism in accordance with one embodiment of the invention.

The actuation mechanism in accordance with the invention is illustrated in FIGS. 4 and 4*a* and utilizes a scotch yoke mechanism 25 to convert rotary motion of an electric motor 25 to linear motion to actuate a lever 27 against the nozzle 18*b* of the AC.

As shown, the motor 25 is mounted and secured within the can top adaptor 16. The motor includes a gear train (not shown, optional) that is connected to torque arm 25*a* having an offset spindle 25*b* for engagement with a slot 27*a* within the lever 27. The lever 27 has a first end 27*b* having the slot 27*a* and a second end 27*c*. The first and second ends are angularly connected to one another at pivot point P such that movement of one end causes movement of the other end in a different direction as determined by the angle between the two ends. Pivot point P is secured within compartment 17 such that the pivot point is stationary with respect to the housing.

As such, rotary motion of the spindle within the slot causes substantially linear motion of the second end as shown in FIG. 4A. That is, as the motor 25 is operated, the torque arm 25*a* is rotated. The offset spindle 25*b* moves in a circular motion with the torque arm. The lever 27 is secured at pivot point P and rotates about an axis parallel to the axis of rotation of the motor spindle. As a result, the circular motion of the offset spindle causes a reciprocating motion of the first end 27*a* of the lever. This causes the second end of the lever arm 27*c* which is perpendicular to the axis of rotation to also move in a reciprocating motion. The relative lengths of the first and second ends of the lever, the offset length of the offset spindle relative to the motor axis and the angle between the two ends will determine the relative linear displacement of each end and the relative direction of movement.

Preferably, the lever is designed and positioned within the compartment 17 such that the motion of the second end of the lever is substantially linear (i.e. a controlled tangent vector) to and against the nozzle of an AC positioned with the can top adaptor and specifically the slot 16*b* of the can top adaptor. In other words, the second end with move in a reciprocating arcuate motion; however, the arc is sufficiently short and has a radius sufficiently large such that the movement relative to the AC stem is substantially parallel.

Preferably, the gear train (if required) includes metal gears in order to improve the life of the gear train. In a typical deployment, a cycle life greater than one million cycles can be achieved with a metal gear train.

Importantly, the scotch yoke provides improved power consumption while minimizing the risk of stalling the motor while providing consistent actuation forces against the AC nozzle. In particular, the scotch yoke is configured such that the two inflection points that provide maximum mechanical advantage of the scotch yoke cycle coincide with the two points of maximum valve actuation force namely at a) seal break (i.e. at the top of stroke) and b) at the point of maximum valve compression (i.e. where spring compression will be greatest). Applying maximum force at the top of stroke is particularly important for new aerosol cans in that new cans often start their life cycle with dry, sticky valves that may require additional force to actuate (up to 7 pounds of force).

Further still, the scotch yoke provides a parabolic increase in available actuation force as the torque arm moves towards the inflection points which correlates well with the force displacement requirements of the aerosol can valve.

Further still, as the scotch yoke is a rotating system, the system provides a fixed and repeatable stroke. As such, a degree of stroke compensation is required due to the potential variations in aerosol can height and valve geometries as discussed above. That is, slight variations in the position of the nozzle relative to the second end of the pivot arm will not affect the actual distance that the nozzle is displaced.

In order to minimize the risk of over-driving the valve (i.e. in situations where the nozzle/valve height is higher than usual), the lever arm is preferably designed with a stiffness so that a valve stem of maximum height geometry will not be damaged by over driving the valve at bottom of dispenser stroke. In other words, it is preferred that the lever arm (and in particular the second end 27*c*) is sufficiently flexible to moderately flex in the event that an excessive resistive force is being applied by the valve.

Figure 12:
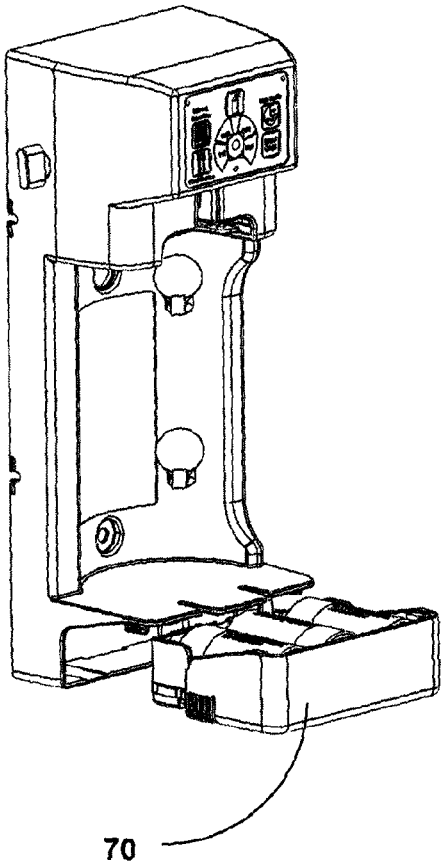
FIG. 12 is a perspective view of dispenser system with a lower battery drawer in accordance with one embodiment of the invention.

An additional benefit of the design is that the actuation mechanism is more compact than traditional designs. This allows for sufficient space to incorporate an additional battery within the control system without increasing the overall footprint of the housing. The extra battery may be used to extend battery life well beyond comparable products in the market. FIG. 12 (described below) shows an embodiment with one configuration for additional batteries.

Power Consumption and Energy Analysis

Different dispenser designs were tested to evaluate the energy efficiency of each design under simulated operating conditions. That is, a series of experiments were designed to simulate the normal operating conditions of a dispenser as well as compromised operating conditions. The first test conditions (Group I) represented the compromised operating conditions where the valve spring of an aerosol can requires an increased force to activate the valve which may have been caused by the valve becoming contaminated with contents such that the activation mechanism must provide an increased force to open the valve. In this group, dispensers operated against a spring having a 7 pound activation force. The second test conditions represented the normal operating conditions where the normal valve opening force is all that is required. In this group, dispensers operated against a spring having a 5 pound activation force.

Energy consumption measurements were made at these two levels as representing the typical range of force that may be required. As is understood, the activation force will usually vary over the life the can regardless of leakage as metered valves will stiffen over time due to the swelling of the stem gasket. This gasket swelling is a function of the gasket material, its reactivity with the solvents used in the formulation, ambient temperature and the length exposure of the solvents to the gasket (dispensing period). The solvents used in low VOC formulations are particularly reactive, which create challenges for US formulations compared to formulas used for Europe or Asia. By testing the dispenser with a 7 lb load, the worst case performance can be estimated.

Figure 7:
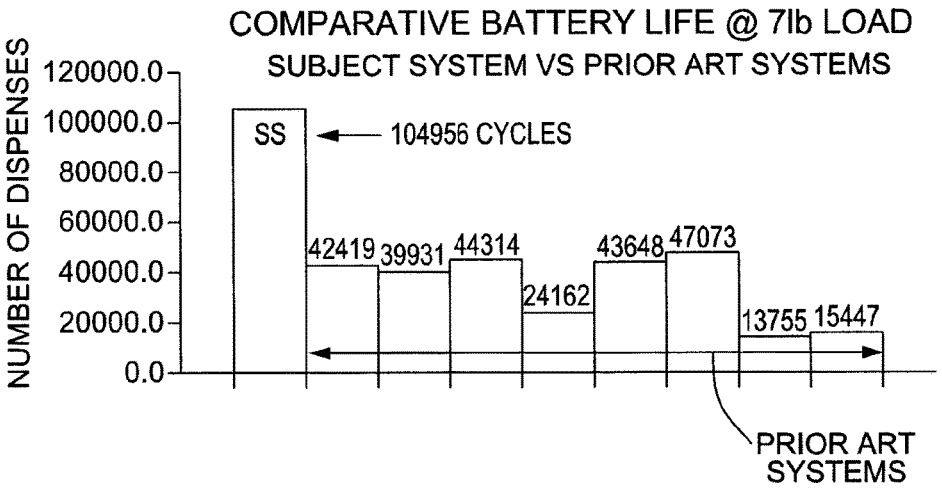
FIG. 7 is a graph comparing battery life for an actuation system in accordance with the invention (SS) and prior art systems at a 7 pound load.
Figure 7A:
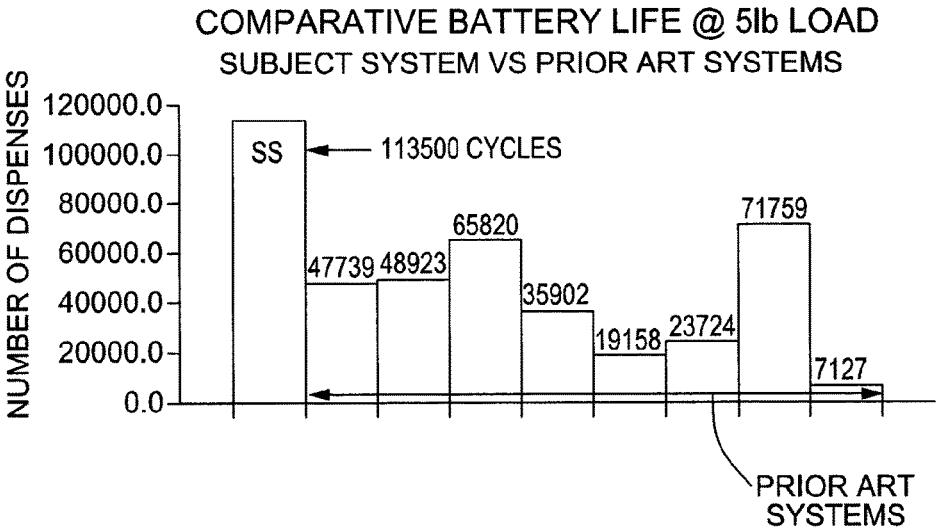
FIG. 7A is a graph comparing battery life for an actuation system in accordance with the invention (SS) and prior art systems at a 5 pound load.

As shown in FIGS. 6, 6A, 7 and 7A, the differences in the energy consumed per cycle at different loads (FIGS. 6 and 6A) and total number of cycles at different loads for equivalent batteries (FIGS. 7 and 7A) are shown for the subject system (SS) as compared to 8 or 9 prior art products. As shown, the subject system consumes less energy per cycle than other systems at the higher load and has substantially equal power consumption to other systems at the lower load. Importantly, as shown in FIGS. 7 and 7A, this translates into a significant improvement in battery life since the subject design makes much better use of the available energy in the batteries (1.4 V vs. 0.4 V usable) compared to other designs by eliminating current spikes that are common in past systems. This is achieved by the lever arm flexibility as described above which minimizes peak apparent load as well as the parabolic power profile of the scotch yoke.

In a typical operating scenario, a dispenser will provide approximately 3,000 dispenses per month. As such, it is predicted that the subject design will achieve a 35 month battery life under full load conditions which represents 2.5 times the battery life of other dispensers (for comparable batteries). When compared to some dispensers that will typically only provide 5 months of battery life under these conditions, this means that the batteries would have to changed 7 times more often in these dispensers as compared to the subject system.

As shown in Table 1, the estimated battery cost and service cycle for different systems is shown below. While the total cost savings appear relatively small, importantly, it is the service cycle that indicates the most significant costs associated with inefficient dispensers. For example, in large properties with multiple dispensers, if it takes on average 30 minutes to recognize a battery failure and organize and change the batteries in a dispenser, the true cost of changing batteries at a labor cost of $20/hour may cost $10 per battery change. As such, if a property has many hundreds of dispensers, the annual cost of changing batteries is very high. Thus, the subject system can provide significant labor savings associated with changing batteries.

TABLE 1

Estimated Annual Battery Cost and Service Cycle

| Design | Annual Battery cost | Service cycle (Months) |
|---|---|---|
| Subject System | $0.78 | 38 |
| System 1 | $1.40 | 15 |
| System 2 | $1.40 | 17 |
| System 3 | $0.92 | 24 |
| System 4 | $3.94 | 2 |
| System 5 | $1.32 | 7 |

Based on published costs for Duracell Procell of:

AA cell=$0.39

C cell=$0.82

D cell=$0.92

Table 2 shows the effect of battery voltage on time to dispense for the subject scotch yoke dispenser. As known, the voltage of a typical alkaline battery will decrease over the life of the battery where for a single battery, the voltage will decrease from an initial value to a lower value where the battery has no usable capacity. By way of example, in a typical "C" cell battery, the usable voltage range is approximately 1.6 volts down to 0.9 volts. As noted above, the scotch yoke system of the subject system completes a single rotation of the offset spindle for each dispense, preferably using a time signal to initiate dispensing and a limit switch to turn off the system upon completion of one rotation. As shown in Table 2 for a system having 3 "C" size batteries, when the batteries are fresh, the voltage is higher and the time to dispense (Td) a fixed quantity of aerosol fluid is shorter. As the battery voltage decreases over the life of the battery, the time to dispense will increase for the minimum or threshold energy output required to complete a dispense cycle. As shown, an average of 0.62 joules is required to complete a dispense cycle whereas the time to dispense increases from 0.95 seconds to 1.79 seconds as the battery voltage drops from 4.5 volts to 2.8 volts. Importantly, and in contrast to prior art systems, when the voltage is high the energy consumed for a dispense cycle is substantially the same (or slightly lower) than the energy consumed when the voltage is low. Thus, as the energy consumed per cycle is consistent regardless of voltage, battery life is substantially improved.

It should be noted that while the time to dispense increases, this does not mean an increase in the quantity of material being dispensed if the aerosol can has a dose valve.

TABLE 2

Battery voltage vs. Time to Dispense for 7 pound and 5 pound valve loads

| Battery Format | 7 pound load 3 × C | |
|---|---|---|
| Vps(V) | J(Ws) | Td(sec)* |

TABLE 2-continued

| Battery voltage vs. Time to Dispense for 7 pound and 5 pound valve loads | | |
|---|---|---|
| 4.5 | 0.58 | 0.95 |
| 4.3 | 0.58 | 1.01 |
| 4.1 | 0.58 | 1.07 |
| 4.0 | 0.58 | 1.09 |
| 3.8 | 0.6 | 1.19 |
| 3.6 | 0.62 | 1.31 |
| 3.4 | 0.63 | 1.39 |
| 3.2 | 0.65 | 1.51 |
| 3.0 | 0.68 | 1.65 |
| 2.8 | 0.69 | 1.79 |
| Average | 0.62 | 1.30 |
| Battery Format | 5 lb load 3 × C | |
| Vps(V) | J(ws) | Td(sec)* |
| 4.5 | 0.5 | 0.86 |
| 4.3 | 0.49 | 0.89 |
| 4.1 | 0.48 | 0.95 |
| 4.0 | 0.47 | 0.98 |
| 3.8 | 0.46 | 1.01 |
| 3.6 | 0.46 | 1.1 |
| 3.4 | 0.46 | 1.15 |
| 3.2 | 0.45 | 1.24 |
| 3.0 | 0.45 | 1.33 |
| 2.8 | 0.47 | 1.47 |
| Average | 0.47 | 1.10 |

In one embodiment as shown in FIG. 12, a dispenser having a lower battery drawer 70 is provided to enable rapid replacement of the batteries. In particular, as in most installations, the base of the dispenser is installed on a wall at a height of at least 7 feet, this embodiment provides an advantage over other systems that are mounted in this manner by providing a lower access point for the batteries. As such, as compared to prior art systems where the batteries are located adjacent the dispensing mechanism and may be at a height of 8+ feet, the lower battery drawer provides lower access for battery replacement.

Keying

Figure 8:
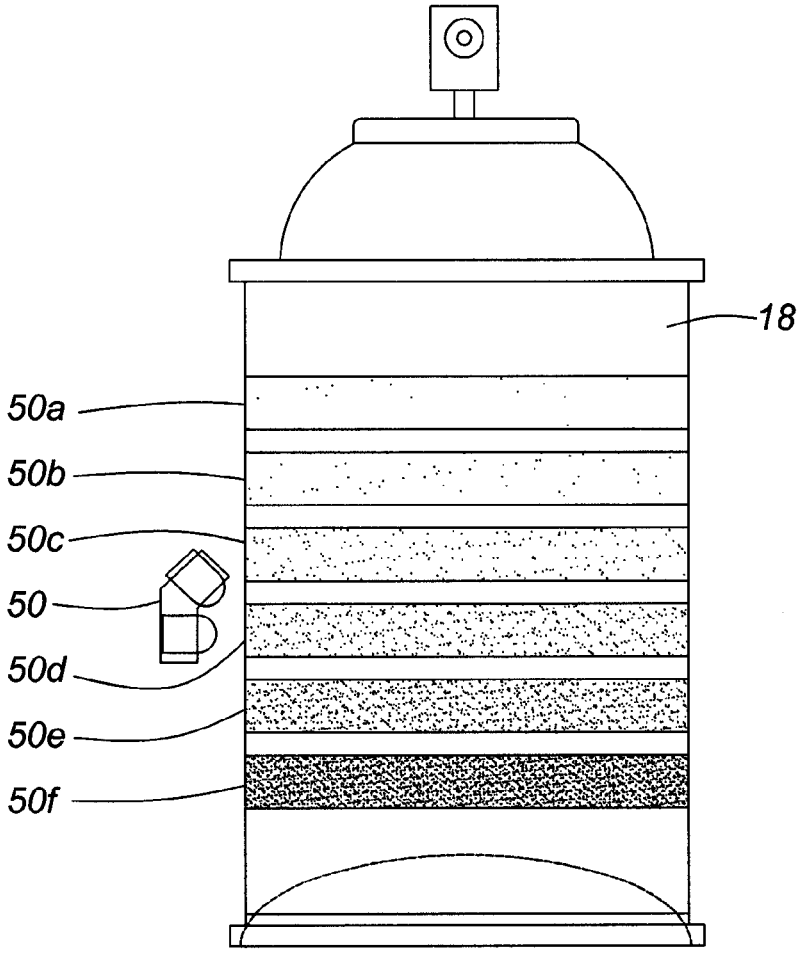
FIG. 8 is a schematic diagram of a keying system in accordance with one embodiment of the invention.
Figure 9:
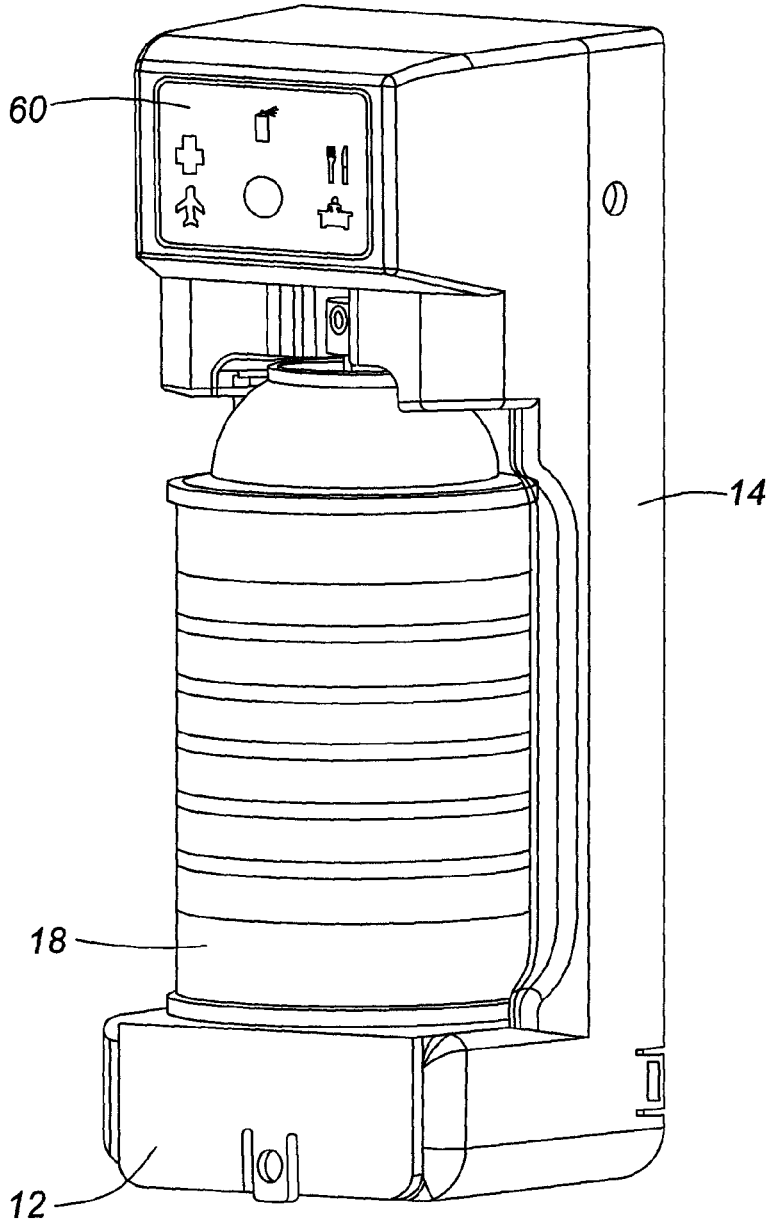
FIG. 9 is a perspective view of dispenser system with mounted aerosol can in accordance with one embodiment of the invention.

In one embodiment, the dispenser is provided with a keying system to prevent unauthorized aerosol cans from being used in the dispenser as shown in FIGS. 8 and 9 and described in Applicant's copending application PCT/CA2011/001008, entitled "Signal and Detection System for Keying Applications" incorporated herein by reference. In this embodiment, an aerosol can 18 is provided with one or more photoreflective bands (PRB) 50*a*-50*f* surrounding the circumference of the aerosol can. A corresponding LED emitter/receiver pair 50 is operatively oriented with respect to one or more PRBs and connected to the dispenser's controller. In operation, at the time that the controller initiates a dispensing cycle and/or detects that the dispenser cabinet has been opened, the controller activates the LED emitter/receiver pair such that LED light is emitted against the outer surface of the aerosol can. The LED emitter/receiver pair is oriented such that emitted light is reflected off the outer surface of the aerosol can to the receiver. The received light signal will have characteristics corresponding to the PRB such that distinct reflected light patterns can be analyzed by the controller and compared to authorized patterns. Generally, the keying system can be used to enable a manufacturer to ensure that only authorized product is utilized within the dispenser 10.

Various coding scenarios, as described in the copending application can be employed including jurisdictional codes that enable the use of particular product in specific jurisdictions only.

The PRB may be visible, not visible or not noticeably visible to the naked eye on the exterior of the AC while remaining visible to the emitter/receiver pair. The PRB may also be visible to the emitter/receiver pair beneath overlying graphics that may be on the AC. The PRB can be applied to directly to the metal surface of the AC or to a paper label.

The emitter/receiver pair may be positioned at different levels within the dispenser so as to operatively connect with a single PRB at a specific height. In this case, for example, a dispenser intended for a specific jurisdiction would include an emitter/receiver at one height and be programmed to interpret a PRB at a corresponding height. For example, as shown in FIG. 8, the emitter/receiver pair will engage with the third PRB 50*d* from the bottom and will only operate with ACs that include a specific PRB at the third level. Alternatively, a dispenser intended for another jurisdiction could have the emitter/receiver pair at a different height and only operate with ACs that include a specific PRB at that other level. Various combinations of emitter/receiver pairs may also be provided to increase the number of coding options.

Touch Programming

Figure 10:
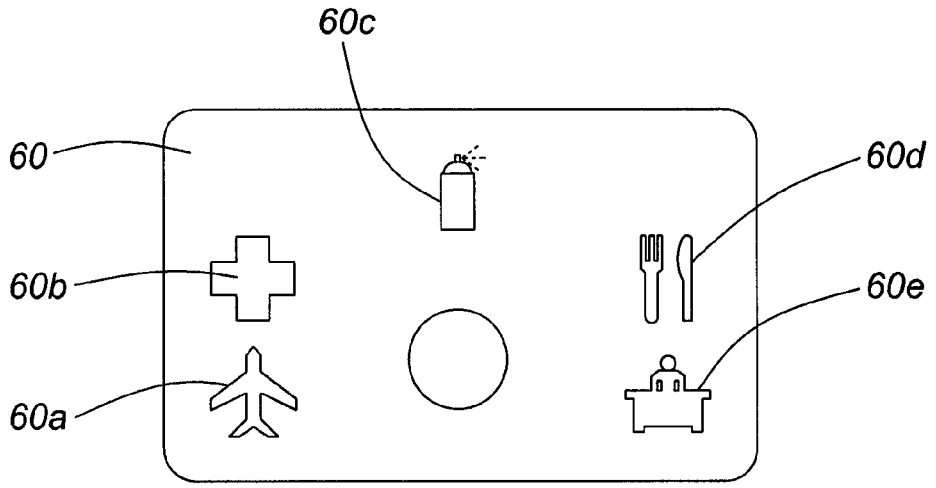
FIG. 10 is a schematic diagram of a programming interface in accordance with one embodiment of the invention.

In one embodiment, the dispenser is provided with a programming interface 60 as shown in FIGS. 9 and 10. In this embodiment, in order to minimize the need and time for programming individual dispensers at the time of installation (or thereafter), the dispenser includes a series of application specific software that provide dispensing routines applicable to a number of common installations.

As shown in FIGS. 9 and 10, an interface 60 with application graphics representing for example, an airport 60*a*, hospital 60*b*, restaurant 60*d*, and office 60*d* are displayed. The interface includes an actuation switch (not shown) beneath the outer surface wherein user-depression of the application graphic will initiate actuation of a corresponding program that has a dispensing schedule corresponding to the installation. In each case, the dispensing schedule has been pre-determined by anticipated traffic for that type of installation.

Figure 11:
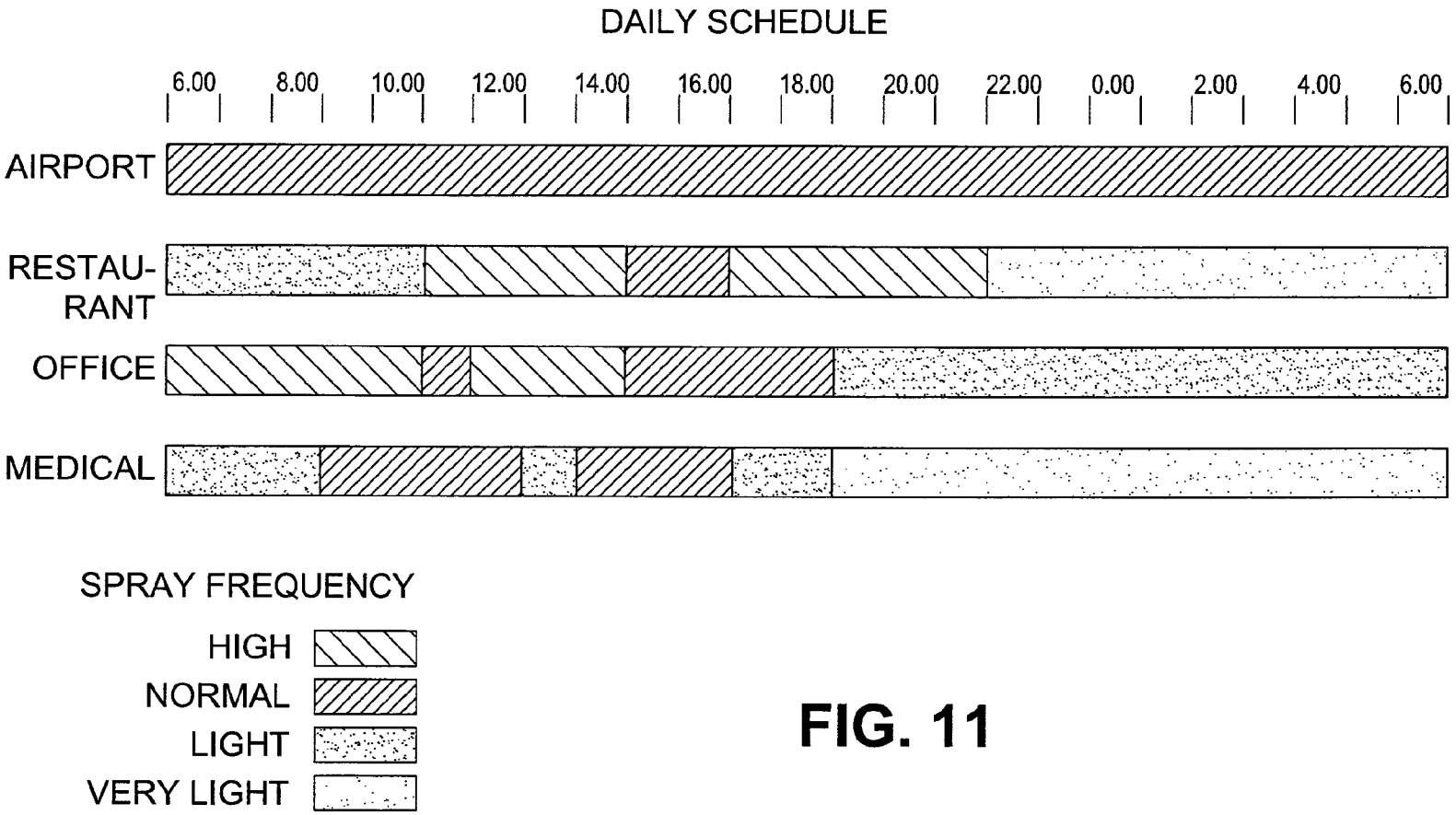
FIG. 11 is a schematic diagram showing possible dispensing schedules for different installations.

FIG. 11 shows a typical dispensing schedule for the above installations. As can be seen, over a 24 hour period for each of an airport, restaurant, office and medical facility, each installation will have different dispensing frequencies for various times of day. For example, each of heavy, normal, light or very light dispensing frequencies may be provided for different times of day in these different installations. Other graphics such as indicator 60*c* may be provided to give an installer or technician a visual warning that the system is about to initiate a dispensing cycle.

Further still, the controller will preferably include a factory set time within the controller such that the installer simply selects the appropriate program and does not have to program the time into each unit. In this case, as units are being manufactured for a specific jurisdiction (for example, North America), the factory would set the time of day for the median North American time (for example, Central Standard Time) thus allowing no more than a ±2 hour "error" in the time of day setting for North American units. In another embodiment, the display interface would include a time display and a plus or minus button that allows the installer to adjust the hour setting on the time display in ±1 hour increments to provide an accurate time of day. Preferably, the system clock is independent of the dispensing power supply such that regular replacement of the dispensing batteries will not necessitate resetting the system clock.

Importantly, the simple programming feature simplifies installation by allowing the installer to simply select the appropriate program for the installation, thus enabling time-efficient installation as well as an efficient dispensing schedule for that installation. In addition, this feature also provides an improved ability to predict service intervals based on the power consumption for a specific installation which overcomes the problem of past dispensing devices that may rely strictly on traffic which then results in effectively random service requirements.

Although the present invention has been described and illustrated with respect to preferred embodiments and preferred uses thereof, it is not to be so limited since modifications and changes can be made therein which are within the full, intended scope of the invention as understood by those skilled in the art.

The invention claimed is:

1. A method for determining if an aerosol can is authorized for use within an aerosol can dispenser where the aerosol can dispenser has an aerosol can dispensing system for repeated mechanical contact with a nozzle of an aerosol can operatively connected to the aerosol can dispenser and where the aerosol can dispensing system has a controller having means for activation of the aerosol can dispensing system for repeated activation of the aerosol can nozzle by a aerosol can dispensing mechanism, the method comprising the steps of:

a. mounting an aerosol can within the aerosol can dispenser to engage the aerosol can nozzle with the aerosol can dispensing mechanism;

b. activating at least one LED emitter/receiver pair operatively connected to the controller, the LED emitter/receiver pair for emitting LED light against an outer surface of an aerosol can and receiving reflected light from the outer surface of the aerosol can;

c. detecting if the reflected light corresponds to an authorized reflected light signal pattern;

wherein if the reflected light signal pattern is authorized, enabling the aerosol can dispensing mechanism to dispense a quantity of aerosol can contents and wherein if the reflected light signal pattern is not authorized, preventing activation of the aerosol can dispensing mechanism.

2. The method according to claim 1 wherein the LED light is emitted onto at least one photoreflective surface for interfacing with the at least one LED emitter/receiver pair.

3. The method according to claim 1, wherein the method comprises:

activating the LED emitter/receiver pair such that LED light is emitted against the outer surface of the aerosol can in response to the controller initiating a dispensing cycle.

4. The method according to claim 1, wherein the method comprises:

activating the LED emitter/receiver pair such that LED light is emitted against the outer surface of the aerosol can in response to detecting that the dispenser cabinet has been opened.

5. The method according to claim 1, wherein the aerosol can dispensing mechanism is configured to implement a predetermined dispensing cycle if the reflected light signal pattern is authorized.

6. The method according to claim 1, wherein combinations of multiple emitter/receiver pairs are used to authorize dispensing of a quantity of aerosol can contents.

7. An aerosol can comprising:

at least one photoreflective surface, the photoreflective surface having reflective properties to provide a reflected light signal pattern when operatively interacting with at least one LED emitter/receiver pair operatively connected to a dispensing apparatus for authorizing use of the aerosol can within the dispensing apparatus; and an aerosol can nozzle configured to engage with the dispensing apparatus to enable repeated activation of the aerosol can nozzle by the dispensing apparatus when the reflected light signal pattern is authorized.

8. The aerosol can as in claim 7 wherein the at least one photoreflective surface is a band around the circumference of the aerosol can.

9. The aerosol according to claim 7, wherein the photoreflective surface is visible.

10. The aerosol can according to claim 7, wherein the photoreflective surface is not visible to the naked eye on the exterior of the aerosol can while remaining detectable to the emitter/receiver pair.

11. The aerosol can according to claim 7, wherein the photoreflective surface is detectable by the emitter/receiver pair beneath overlying graphics.

12. The aerosol can according to claim 7, wherein the photoreflective surface is provided directly on the metal surface of the aerosol can.

13. The aerosol can according to claim 7, wherein the photoreflective surface is provided on a label affixed to the aerosol can.

14. The aerosol can according to claim 7, wherein the aerosol can comprises a plurality of photoreflective surfaces, wherein each photoreflective surface is a band around the circumference of the aerosol can, each band having a different height.

* * * * *